US006513780B1

(12) United States Patent
Cox et al.

(10) Patent No.: US 6,513,780 B1
(45) Date of Patent: Feb. 4, 2003

(54) PICTURE OR PLAQUE HANGING AID

(76) Inventors: Levon Cox, P.O. Box 182, Maynard, AR (US) 72444; Dave Cox, 1194 Tweedy Trail, Pocahontas, AR (US) 72455

( * ) Notice: Subject to any disclaimer, the term of this patent is extended or adjusted under 35 U.S.C. 154(b) by 0 days.

(21) Appl. No.: 09/672,491

(22) Filed: Sep. 29, 2000

(51) Int. Cl.[7] ..... A47G 1/16
(52) U.S. Cl. ..... 248/490
(58) Field of Search ..... 248/468, 475.1, 248/488, 490

(56) References Cited

U.S. PATENT DOCUMENTS 4,614,322 A * 9/1986 Goetz ..... 248/490
5,180,135 A * 1/1993 Hindall ..... 248/475.1 X
5,259,583 A * 11/1993 Meredith ..... 248/494
6,007,041 A * 12/1999 Law ..... 248/491

* cited by examiner

*Primary Examiner*—Ramon O. Ramirez
(74) *Attorney, Agent, or Firm*—Walker, McKenzie & Walker PC

(57) ABSTRACT

Picture or Plaque Hanging Aid comprising: a length of stretchable elastic band, a rigid hook fixedly attached to each end of said band, and a bead frictionally mounted to said elastic band so that said bead can be slid to any portion of said band and remain in place when released. A preferred embodiment includes wherein a plurality of beads are frictionally mounted to said elastic band for marking a plurality of anchor placing locations. The user hooks the elastic band to the back of the plaque or picture, slides the ball to the anchor fastening location, places a transferrable mark on the bead with an ink pen so that when the picture or plaque is placed in the desired location on a wall, the mark is transferred to the wall thereby indicating the spot where a picture or plaque hanging anchor is to be fastened to the wall.

5 Claims, 3 Drawing Sheets

PICTURE OR PLAQUE HANGING AID

BACKGROUND OF THE INVENTION

This invention relates generally to the field of picture hanging devices, and more particularly to a picture or plaque hanging aid.

It is common for people to decorate their homes, offices and the like with items such as pictures, paintings, plaques, flat sculptures and the like. Pictures, plaques and the like usually have a hanging means located on their back. Some pictures have small eye screws attached to each side of the picture frame and a hanging wire attached and stretched from one eye screw to the other. Other items such as plaques may have a central hanging bracket or tab with an anchor retaining aperture or other anchor retaining means located on the back. Some items such as flat wall sculptures may be irregular in shape and also have a hanging bracket mounted to the back. To hang the above mentioned items on a wall a person must temporarily hold the item against the wall in the desired location, place a mark on the wall corresponding to the top and, or bottom of the item as well as placing a mark at the left and, or right edges of the item. The person must then measure the location of the hanging bracket or, in the case of a picture hanging wire, must measure the location of the spot where the wire is tensioned as it will be when the picture is in the hung position with respect to the top and or bottom of the item being hung. Then the person must that same distance from the top and or the bottom marks that have been scribed on the wall and place a mark on the wall to indicate the height location of the anchor placement. A similar process must be performed when finding the center with respect to the left and right side of the item to be hung. Irregular shaped plaques or pieces of flat sculpture are even harder to measure and mark. The above described method of measuring the anchor hanging location on the back of a picture or plaque and the measuring and marking of the wall where the item is to be hung is quite time consuming and tedious. When the item to be hung is irregular in shape it is even more difficult and time consuming to make the proper measurements.

SUMMARY OF THE INVENTION

The primary object of the invention is to provide a picture or plaque hanging aid that helps a person to quickly determine the exact location of where to place a nail, hook or other anchoring device once the picture or plaque location is determined.

Another object of the invention is to provide a picture or plaque hanging aid that marks the spot where a nail, hook or anchor is to be placed.

Another object of the invention is to provide a picture or plaque hanging aid that is easily adaptable to any size or shape of item to be hung.

A further object of the invention is to provide a picture or plaque hanging aid that is easy to use and inexpensive to manufacture.

Other objects and advantages of the present invention will become apparent from the following descriptions, taken in connection with the accompanying drawings, wherein, by way of illustration and example, an embodiment of the present invention is disclosed.

Picture or Plaque Hanging Aid comprising: a length of stretchable elastic band, a rigid hook fixedly attached to each end of said band, and a bead frictionally mounted to said elastic band so that said bead can be slid to any portion of said band and remain in place when released.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
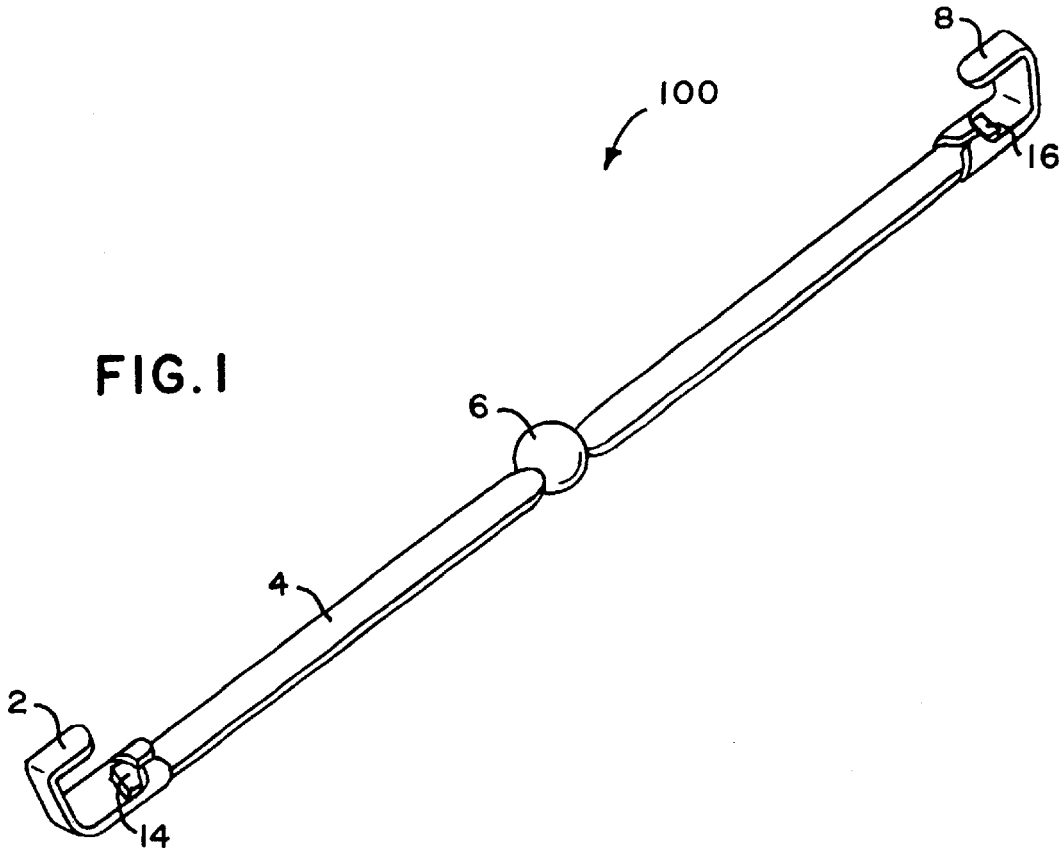
FIG. 1 is a perspective view of the present invention
Figure 2:
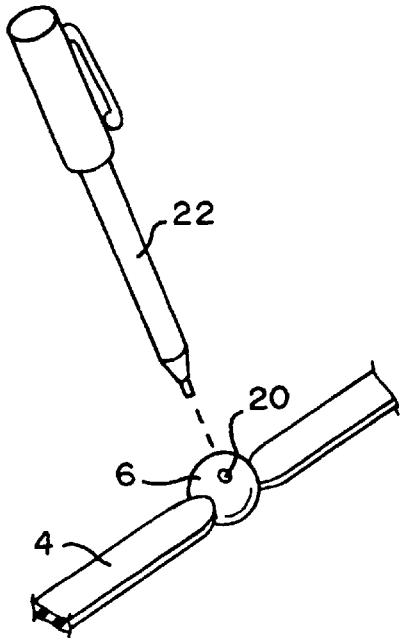
FIG. 2 is a partial perspective view of the present invention showing the marking means
Figure 3:
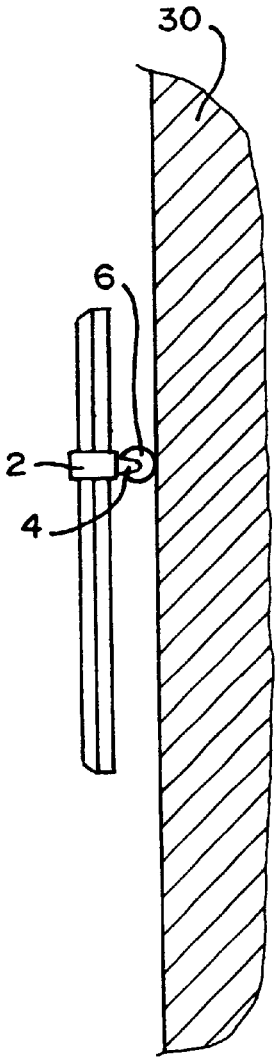
FIG. 3 is a side view of the present invention in use.
Figure 4:
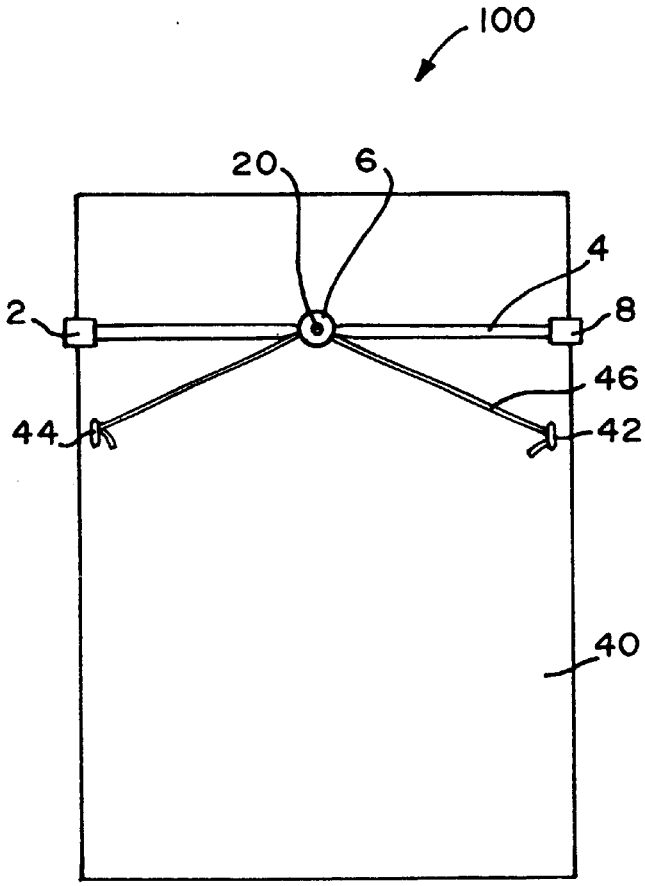
FIG. 4 is a rear view of the present invention in use on a wire hanging picture configuration.
Figure 5:
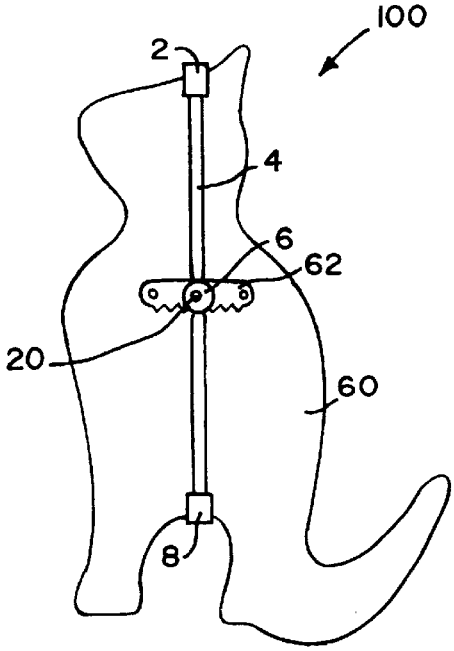
FIG. 5 is a rear view of the present invention in use on an irregularly shaped wall plaque.
Figure 6:
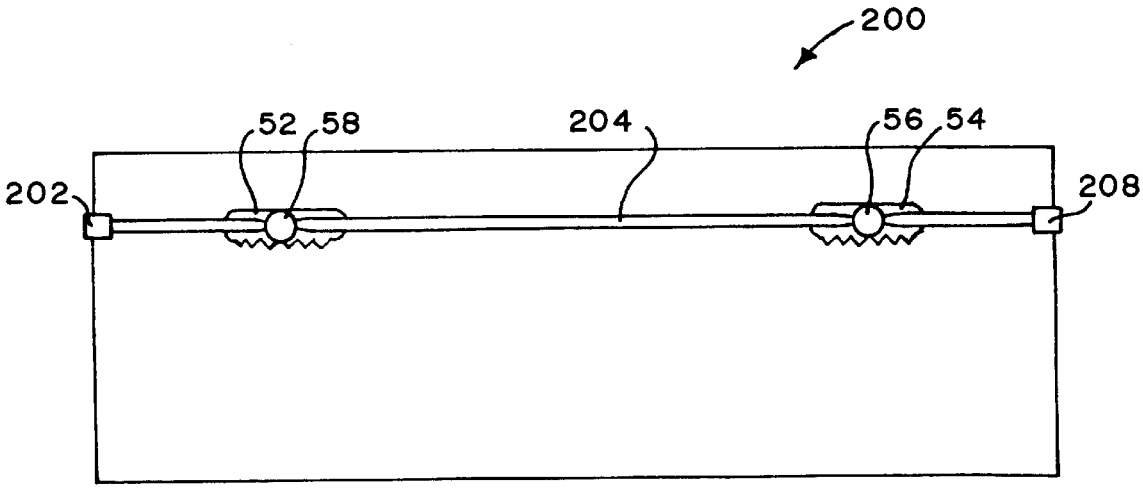
FIG. 6 is a rear view of the present invention in use on a large item.

Referring now to FIG. 1 we see a perspective view of the picture hanging aid of the present invention 100. The invention consists of elastic band 4, slidable bead 6 and hooks 2 and 8 that are fixedly attached to each end 14, 16 of band 4. FIG. 2 shows a partial perspective view of the present invention showing how a user can mark bead 6 with a marking pen 22. The bead 6 is made of a rigid material that is non porous so that when the ink from fiber tipped pen 22 is applied at point 20, it remains on the surface of bead 6 and can be transferred to a wall surface as shown in FIG. 3 so that the ink mark 20 that was placed on bead 6 is transferred to the wall 30 thereby creating an indication of where to place a picture or plaque hanging anchor such as a nail or picture hook. Because band 4 is elastic it can be stretched to accommodate a wide variety of widths and shapes of pictures, plaques and the like. To use the present invention 100 the user places hooks 2, 8 around the edges of a picture frame 40 as shown in FIG. 4. In this example the picture frame is equipped with eye hooks 42, 44 to which a wire 46 is attached. To hang picture 40 in the desired location the user puts his or her finger under the center of wire 46 and puts it under tension as shown by the inverted V configuration of wire 46. The user then takes the present invention and fastens it to opposing edges of frame 40 as shown. The user then slides bead 6 to the apex of the wire 46. The user then places a pen mark 20 on bead 6 and then takes the entire picture 40, with picture hanging aid 100 of the present invention left in place, and holds the picture 40 on the specified wall in the desired location. The user then presses the picture gently against the wall causing the ink mark 20 to transfer to the wall. The user then removes the picture 40 from the wall and installs a picture hanging anchor such as a picture hook at the location of the transferred ink mark 20. The user then removes the present invention 100 from the picture 40 and proceeds to hand the picture on the wall. This procedure guarantees the accurate placement of the picture without the tedious measuring normally associated with the accurate placement of a picture onto a wall. FIG. 5 shows that the present invention can attach and work with a wall plaque 60 even if such a plaque has an irregular shape. In the present case bead 6 has been slid to the spot where hanging bracket 62 is located. Transfer dot 20 can now be used to locate the exact spot for nailing an anchor or picture hook or the like. FIG. 6 shows how a large picture can be accommodated by an alternate embodiment of the present invention 200. In this case a longer band 204 is employed and two beads 58, 56 are used to locate picture hanging spots 52, 54. Hooks 202, 208 are similar to hooks already described in the main embodiment 100. Because the present invention 100 is so inexpensive to manufacture, it is conceivable that several versions of the invention having bands 4 of various lengths can be packaged for sale as one system. Included in the package could be one variation of the alternate embodiment having two beads instead of one.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A hanging aid device for securing a picture or plaque from a wall, comprising:

an elastic band having two ends; and a first rigid hook fixedly attached to the second end of the band;

a second rigid hook fixedly attached to the second end of the band; and a marker means for marking a location on the wall, said marker means fictionally secured to the band and slidable adjusted along the length of the band to a desired location.

2. The hanging device recited in claim 1, wherein said marker means is a bead.

3. The hanging device recited in claim 1, wherein said marker means is a plurality of beads.

4. The hanging device recited in claim 2, wherein said bead is made of a rigid non porous material to retain ink received from a tipped pen and transfer it to the wall.

5. The hanging device recited in claim 3, wherein said beads are made of a rigid non porous material to retain ink received from a tipped pen and transfer it to the wall.

* * * * *